US009678472B2

(12) United States Patent
Kinoshita et al.

(10) Patent No.: US 9,678,472 B2
(45) Date of Patent: Jun. 13, 2017

(54) IMAGE FORMING APPARATUS HAVING FAN DISPOSED BETWEEN EXHAUST PORT AND FILTER AND CONTROLLING FAN TO GENERATE AIR CURRENT

(71) Applicant: Brother Kogyo Kabushiki Kaisha, Nagoya-shi, Aichi-ken (JP)

(72) Inventors: Naohisa Kinoshita, Nagoya (JP); Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/080,006

(22) Filed: Mar. 24, 2016

(65) Prior Publication Data

US 2016/0282807 A1 Sep. 29, 2016

(30) Foreign Application Priority Data

Mar. 26, 2015 (JP) ..... 2015-064215

(51) Int. Cl.
*G03G 21/00* (2006.01)
*G03G 21/20* (2006.01)
*F24F 11/00* (2006.01)

(52) U.S. Cl.
CPC ..... *G03G 21/206* (2013.01); *F24F 11/0012* (2013.01); *F24F 2011/0023* (2013.01)

(58) Field of Classification Search
CPC ... G03G 21/20; G03G 21/206; F24F 11/0012; F24F 11/0079; F24F 2011/0023
USPC ..... 399/92, 93, 98
See application file for complete search history.

(56) References Cited

U.S. PATENT DOCUMENTS 5,138,375 A * 8/1992 Iimori ..... G03G 21/206 165/300
7,729,633 B2 * 6/2010 Bildstein ..... G03G 15/55 399/91
8,554,104 B2 10/2013 Shimoyama et al.
2005/0055990 A1 * 3/2005 Choi ..... F24F 3/16 55/487
2008/0110187 A1 * 5/2008 Han ..... F24F 11/0012 62/159
2011/0211860 A1 * 9/2011 Shimoyama ..... G03G 15/2064 399/93
2011/0229184 A1 9/2011 Kashimoto et al.
(Continued)

FOREIGN PATENT DOCUMENTS

JP 08254939 A * 10/1996
JP 2005-126191 A 5/2005
(Continued)

*Primary Examiner* — Robert Beatty
(74) *Attorney, Agent, or Firm* — Banner & Witcoff, Ltd.

(57) ABSTRACT

An image forming apparatus including a fan disposed between an exhaust port and a filter, and a controller configured to perform at least one of first fan control and second fan control when at least one switching condition is satisfied among one or more switching conditions for switching fan control, the first fan control being for controlling the fan to generate an air current when an in-apparatus temperature detected by a temperature sensor is higher than a threshold temperature, the second fan control being for controlling the fan to generate an air current when an air contamination amount detected by a contamination sensor is larger than a threshold contamination amount.

15 Claims, 10 Drawing Sheets

(56) References Cited

U.S. PATENT DOCUMENTS

| | | | | |
|---|---|---|---|---|
| 2014/0056608 | A1* | 2/2014 | Miura | G03G 15/205 399/92 |
| 2014/0216259 | A1* | 8/2014 | Iwaki | F24F 3/166 96/19 |
| 2015/0277372 | A1* | 10/2015 | Satou | G03G 21/206 399/93 |

FOREIGN PATENT DOCUMENTS

| | | | | |
|---|---|---|---|---|
| JP | 2006208444 | A | * | 8/2006 |
| JP | 2008-112064 | A | | 5/2008 |
| JP | 2009-031403 | A | | 2/2009 |
| JP | 2011-180236 | A | | 9/2011 |
| JP | 2011-197290 | A | | 10/2011 |
| JP | 2014102287 | A | * | 6/2014 |

* cited by examiner

IMAGE FORMING APPARATUS HAVING FAN DISPOSED BETWEEN EXHAUST PORT AND FILTER AND CONTROLLING FAN TO GENERATE AIR CURRENT

CROSS-REFERENCE TO RELATED APPLICATION

This application claims priority under 35 U.S.C. §119 from Japanese Patent Application No. 2015-064215 filed on Mar. 26, 2015. The entire subject matter of the application is incorporated herein by reference.

BACKGROUND

Technical Field

The following description relates to an image forming apparatus having a fan and a filter, more particularly to one or more techniques for controlling the fan of the image forming apparatus.

Related Art

An image forming apparatus, which includes a fan, has been known that is configured to control operations of the fan to prevent an excessive rise in temperature inside the apparatus (hereinafter referred to as "in-apparatus temperature"). Further, a technique has been known that provides an image forming apparatus with an air cleaning function to discharge air out of the apparatus via an air filter.

As an example of the image forming apparatus having the air cleaning function, a printer has been known that includes a fan and an air filter and is configured to control the fan to operate at a maximum rotational speed while performing an image forming operation, and control the fan to operate at a rotational speed depending on a user-selected one of operational modes while not performing an image forming operation.

SUMMARY

However, the known image forming apparatus has the following problem. That is, the known image forming apparatus is not configured to control operations of the fan to concurrently meet both of a requirement for preventing an excessive rise in in-apparatus temperature and a requirement for air cleaning. Therefore, when the fan is rotated at a constant rotational speed in a user-selected mode or in a mode depending on whether to perform an image forming operation, the fan might not be operated in a preferable manner. For instance, when the fan is rotated at an unnecessarily high rotational speed, it causes a high level of noises and/or a rise in power consumption. Further, when the fan is rotated at a constant rotational speed, at least one of the requirements might not be satisfied such as the requirement for preventing an excessive rise in in-apparatus temperature and the requirement for air cleaning. Thus, improved techniques for controlling the fan are needed.

Aspects of the present disclosure are advantageous to provide one or more improved techniques, for an image forming apparatus having an air cleaning function using a fan, which make it possible to operate the fan in a preferable manner.

According to aspects of the present disclosure, an image forming apparatus is provided, which includes an exhaust port, a filter configured to catch scattering particles from air passed therethrough, a fan disposed between the exhaust port and the filter, the fan being configured to generate an air current, a temperature sensor configured to detect an in-apparatus temperature by outputting signals varying depending on the in-apparatus temperature, the in-apparatus temperature being a temperature in a particular position inside the image forming apparatus, a contamination sensor configured to detect air contamination amount by outputting signals varying depending on the air contamination amount, the air contamination amount representing an amount of particles scattering in a particular volume of air, an image forming unit, and a controller configured to perform at least one of first fan control and second fan control when at least one switching condition is satisfied among one or more switching conditions for switching fan control, the first fan control being for controlling the fan to generate an air current when the in-apparatus temperature detected by the temperature sensor is higher than a threshold temperature, the second fan control being for controlling the fan to generate an air current when the air contamination amount detected by the contamination sensor is larger than a threshold contamination amount.

According to aspects of the present disclosure, further provided is a method adapted to be implemented on a processor coupled with an image forming apparatus having a fan disposed between an exhaust port and an air filter, the method including performing first fan control when at least one condition is satisfied among one or more conditions for controlling the fan, the first fan control including acquiring an in-apparatus temperature detected by a temperature sensor disposed inside the image forming apparatus, determining whether the acquired in-apparatus temperature is higher than a threshold temperature, when determining that the acquired in-apparatus temperature is higher than the threshold temperature, setting a first rotational speed to a speed more than zero, and when determining that the acquired in-apparatus temperature is not higher than the threshold temperature, setting the first rotational speed to zero, determining whether a storage device of the image forming apparatus stores specific information representing that air cleaning is highly required, when determining that the storage device does not store the specific information, setting a rotational speed for rotating the fan to the first rotational speed, when determining that the storage device stores the specific information, performing second fan control including acquiring an air contamination amount detected by a contamination sensor of the image forming apparatus, the air contamination amount representing an amount of particles scattering in a particular volume of air outside the image forming apparatus, determining whether the acquired air contamination amount is larger than a threshold contamination amount, when determining the acquired air contamination amount is larger than the threshold contamination amount, setting a second rotational speed to a speed more than zero, and when determining the acquired air contamination amount is not larger than the threshold contamination amount, setting the second rotational speed to zero, determining whether the first rotational speed is higher than the second rotational speed, when determining that the first rotational speed is higher than the second rotational speed, setting the rotational speed for rotating the fan to the first rotational speed, and when determining that the first rotational speed is not higher than the second rotational speed, setting the rotational speed for rotating the fan to the second rotational speed.

According to aspects of the present disclosure, further provided is a non-transitory computer-readable medium storing computer-readable instructions that are executable by a processor coupled with an image forming apparatus, the image forming apparatus including a fan disposed between an exhaust port and an air filter, the instructions being configured to, when executed by the processor, cause the processor to, when at least one condition is satisfied among one or more conditions for controlling the fan, perform first fan control including acquiring an in-apparatus temperature detected by a temperature sensor disposed inside the image forming apparatus, determining whether the acquired in-apparatus temperature is higher than a threshold temperature, when determining that the acquired in-apparatus temperature is higher than the threshold temperature, setting a first rotational speed to a speed more than zero, and when determining that the acquired in-apparatus temperature is not higher than the threshold temperature, setting the first rotational speed to zero, determine whether a storage device of the image forming apparatus stores specific information representing that air cleaning is highly required, when determining that the storage device does not store the specific information, set a rotational speed for rotating the fan to the first rotational speed, when determining that the storage device stores the specific information, perform second fan control including acquiring an air contamination amount detected by a contamination sensor of the image forming apparatus, the air contamination amount representing an amount of particles scattering in a particular volume of air outside the image forming apparatus, determining whether the acquired air contamination amount is larger than a threshold contamination amount, when determining the acquired air contamination amount is larger than the threshold contamination amount, setting a second rotational speed to a speed more than zero, and when determining the acquired air contamination amount is not larger than the threshold contamination amount, setting the second rotational speed to zero, determine whether the first rotational speed is higher than the second rotational speed, when determining that the first rotational speed is higher than the second rotational speed, set the rotational speed for rotating the fan to the first rotational speed, and when determining that the first rotational speed is not higher than the second rotational speed, set the rotational speed for rotating the fan to the second rotational speed.

BRIEF DESCRIPTION OF THE ACCOMPANYING DRAWINGS

FIG. 1 is a cross-sectional side view schematically showing a configuration of a printer in an illustrative embodiment according to one or more aspects of the present disclosure.

FIG. 2 exemplifies a positional relationship between a fan and a filter that are disposed in the printer in the illustrative embodiment according to one or more aspects of the present disclosure.

Figure 10:
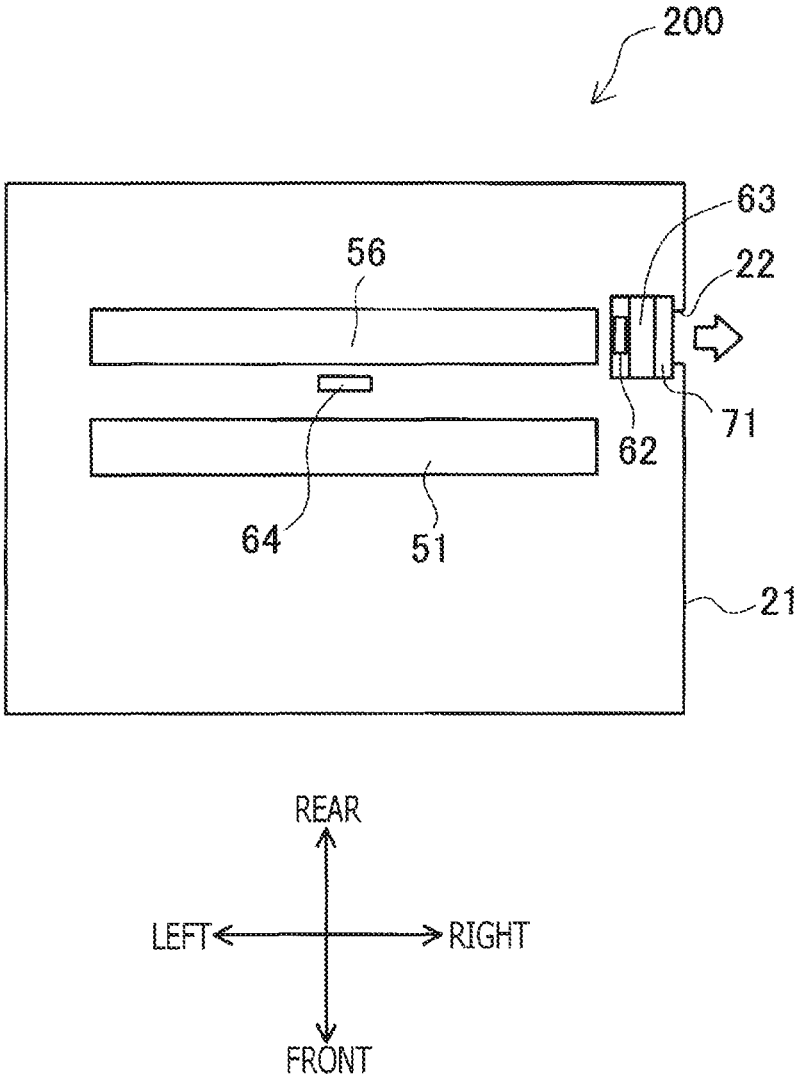

FIG. 10 exemplifies a positional relationship between a fan and a filter that are disposed in a printer in a modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

Hereinafter, an illustrative embodiment according to aspects of the present disclosure will be described with reference to the accompanying drawings. In the illustrative embodiment, aspects of the present disclosure are applied to a printer having a fan.

Figure 1:
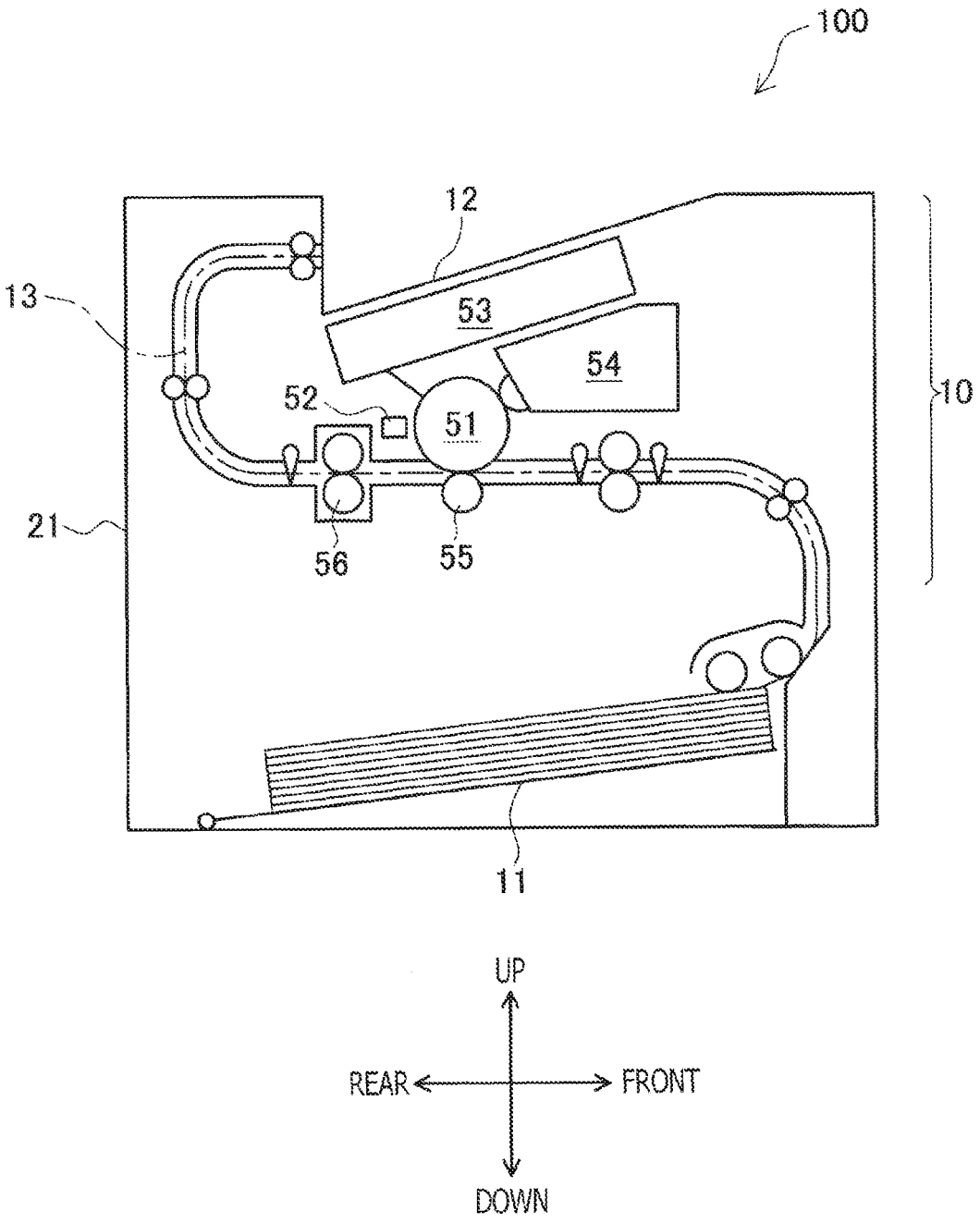

As shown in FIG. 1, a printer 100 of the illustrative embodiment includes an image forming unit 10, a feed tray 11, and a discharge tray 12. The image forming unit 10 is configured to print an image on a sheet. The feed tray 11 is configured to accommodate sheets to be fed to the image forming unit 10. The discharge tray 12 is configured to support sheets with images printed thereon by the image forming unit 10. Further, inside the printer 100, a sheet conveyance path 13 is formed. The sheet conveyance path 13 extends from the feed tray 11 to the discharge tray 12 via the image forming unit 10. The printer 100 further includes a housing 21 configured to entirely cover the image forming unit 10. It is noted that a front side, a rear side, an upside, and a downside of the printer 100 are defined as indicated by arrows in FIG. 1.

The image forming unit 10 is configured to electrophotographically form an image on a sheet that is conveyed through the sheet conveyance path 13. As shown in FIG. 1, the image forming unit 10 includes a photoconductive body 51, a charger 52, an exposure unit 53, a development unit 54, a transfer unit 55, and a fuser unit 56. The image forming unit 10 is an example of an image forming unit. The fuser unit 56 is an example of a fuser unit.

Figure 2:
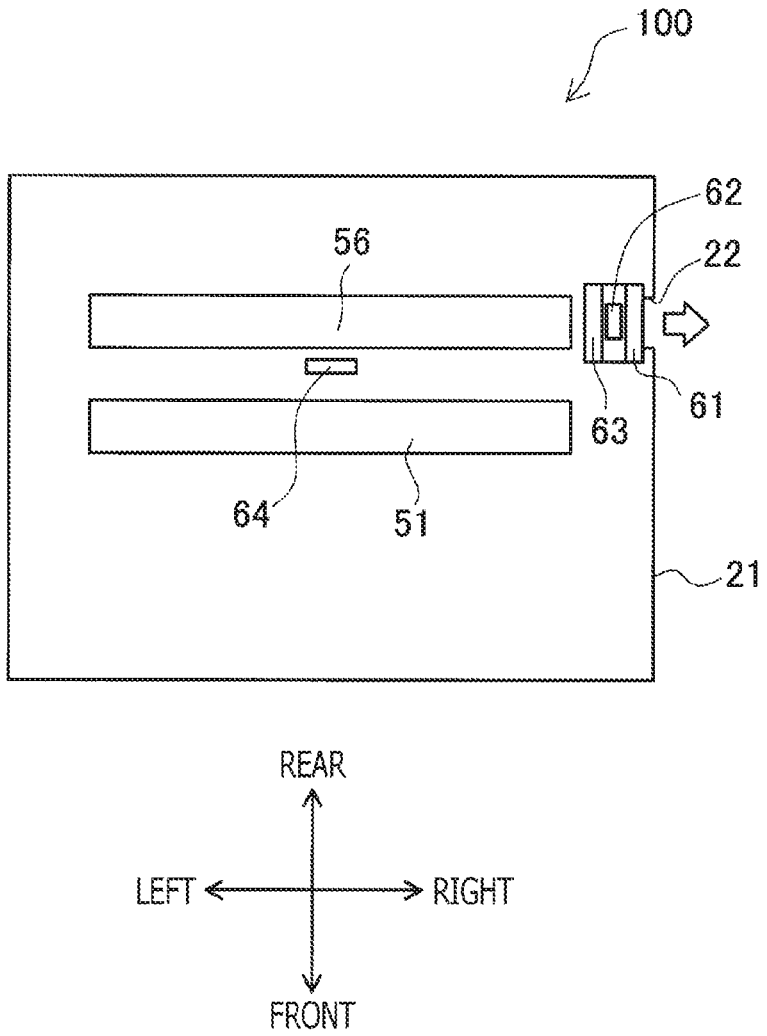

The photoconductive body 51 is a roller member having a longitudinal direction perpendicular to a flat surface on which FIG. 1 is drawn. FIG. 2 is a plane view showing a positional relationship between the photoconductive body 51 and the fuser unit 56. It is noted that the front side, the rear side, a left side, and a right side of the printer 100 are defined as indicated by arrows in FIG. 2.

As shown in FIG. 2, the housing 21 includes an exhaust port 22 formed in a position on a line extending along an axial direction of the fuser unit 56. In FIG. 2, the exhaust port 22 is disposed on a right side of the fuser unit 56. Nonetheless, the exhaust port 22 may be disposed on a left side of the fuser unit 56. The printer 100 further includes a fan 61, a dust sensor 62, and a filter 63 in an order from the exhaust port 22 in a leftward direction. The fan 61, the dust sensor 62, and the filter 63 are arranged between the exhaust port 22 and the fuser unit 56. The printer 100 further includes a temperature sensor 64 disposed close to a central portion of the fuser unit 56 in a longitudinal direction of the fuser unit 56. The fan 61 is an example of a fan. The dust sensor 62 is an example of a contamination sensor. The filter 63 is an example of a filter or an air filter. The temperature sensor 64 is an example of a temperature sensor.

For instance, the fan 61 may be a propeller fan. The fan 61 is a bidirectional fan configured to, when reversely rotated, reverse an air current direction. Namely, the printer 100 is allowed to generate an air current directed from the inside to the outside of the printer 100 and generate an air current directed from the outside to the inside of the printer 100.

For instance, the filter 63 may be a commercially available HEPA filter (which is an abbreviated form of "High Efficiency Particulate Air filter"). The filter 63 is configured to capture particles scattering in an air current flowing toward a surface of the filter 63. In other words, the filter 63 is configured to catch or remove scattering particles from air passed therethrough. In the printer 100, when an air current flowing from the inside to the outside of the printer 100 is generated by the fan 61, clean air that has passed through the filter 63 is exhausted out of the printer 100 via the exhaust port 22.

For instance, the dust sensor 62 may be a light scattering type sensor. The dust sensor 62 is configured to issue output signals depending on an amount of particles (e.g., dust and smoke) scattering in air. For instance, the temperature sensor 64 may be a thermistor. The temperature sensor 64 is configured to issue output signals depending on a temperature in its detection position.

In an image forming operation, the printer 100 charges the photoconductive body 51 by the charger 52, and exposes the photoconductive body 51 by the exposure unit 53. Thereby, an electrostatic latent image based on print data is formed on a surface of the photoconductive body 51. Subsequently, the printer 100 supplies toner onto the electrostatic latent image by the development unit 54, and forms a toner image on the surface of the photoconductive body 51. Further, the printer 100 transfers the toner image from the photoconductive body 51 onto a sheet being conveyed between the photoconductive body 51 and the transfer unit 55, by the transfer unit 55. Thereafter, the printer 100 thermally fixes the toner image transferred on the sheet, by the fuser unit 56. The fuser unit 56 includes a heater and is controlled to thermally fix the toner image at an appropriate fixing temperature adjusted with the heater.

Figure 3:
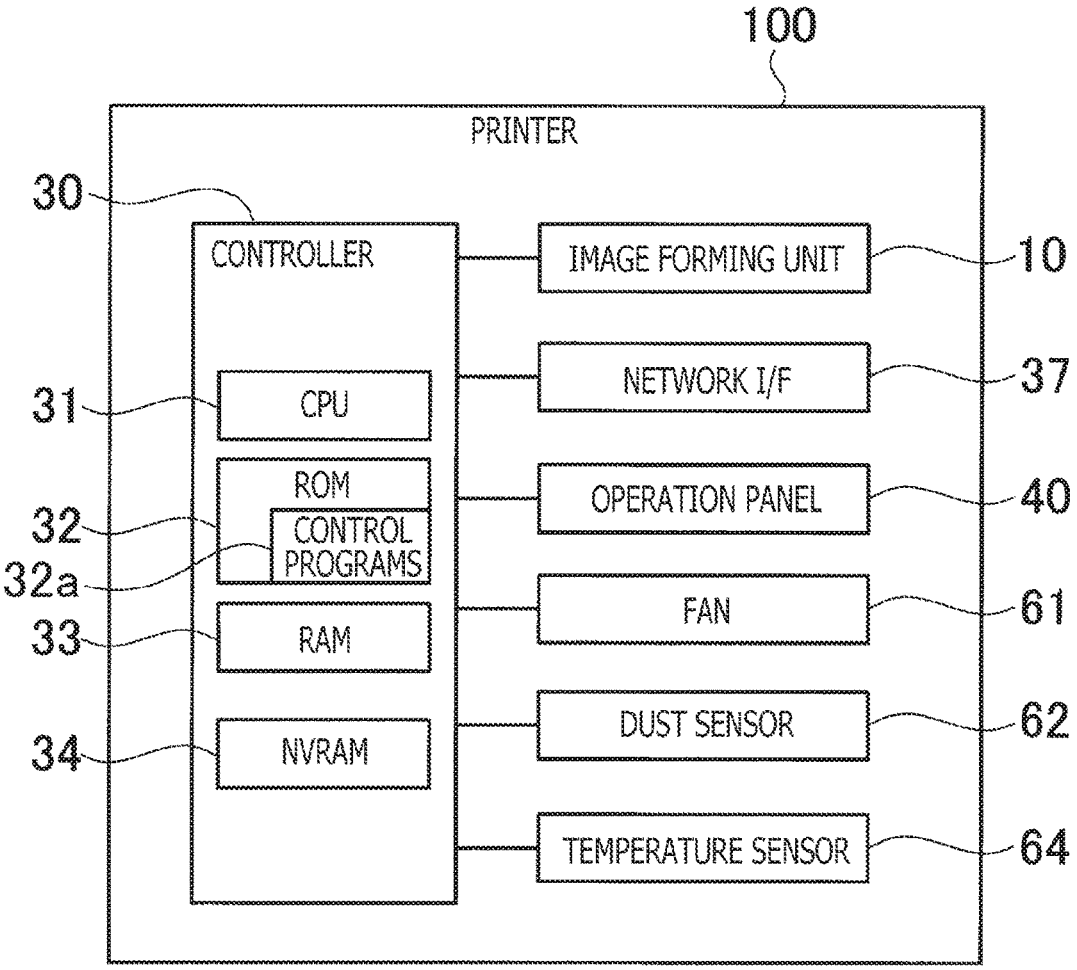
FIG. 3 is a block diagram schematically showing an electrical configuration of the printer in the illustrative embodiment according to one or more aspects of the present disclosure.

Subsequently, an electrical configuration of the printer 100 will be described. As shown in FIG. 3, the printer 100 includes a controller 30. The controller 30 includes a central processing unit (hereinafter referred to as "CPU") 31, a read-only memory (hereinafter referred to as "ROM") 32, a random access memory (hereinafter referred to as "RAM") 33, and a non-volatile random access memory (hereinafter referred to as "NVRAM") 34. Further, the printer 100 includes the image forming unit 10, a network interface (hereinafter referred to as "network IF") 37, an operation panel 40, the fan 61, the dust sensor 62, and the temperature sensor 64. The aforementioned elements included in the printer 100 are electrically connected with the controller 30. It is noted that the "controller 30" shown in FIG. 3 is a generic name of an aggregate of hardware elements (e.g., the CPU 31, the ROM 32, the RAM 33, and the NVRAM 34) used for controlling the printer 100, and may not necessarily represent a single hardware element actually existing in the printer 100.

The ROM 32 stores therein control programs 32*a*, settings, and initial values for controlling the printer 100. The RAM 33 is used as a work area into which the control programs 32*a* are loaded, or a storage area in which data is temporarily stored. According to the control programs 32*a* read out from the ROM 32, the CPU 31 controls each of elements included in the printer 100 while storing processing results into at least one of the RAM 33 and the NVRAM 34. The NVRAM 34 is an example of a storage device. The storage device may include the ROM 32 or the RAM 33. The ROM 32 is an example of a memory. The memory may include the NVRAM 34. The CPU 31 is an example of a controller. The controller 30 may be an example of the controller.

The network IF 37 is a hardware element configured to communicate with devices connected therewith via a network, e.g., using a LAN cable. The operation panel 40 includes a liquid crystal display (hereinafter referred to as "LCD"), and buttons that include a start key, a stop key, and numeric keys. The operation panel 40 is configured to display information for a user and accept an input of an instruction from the user.

Next, operations by the fan 61 will be described. The printer 100 is configured to perform, as operations by the fan 61, a heat discharging operation of discharging heart from the inside to the outside of the printer 100 and an air cleaning operation of reducing an amount of particles in air around the fan 61 and cleaning the air. The heat discharging operation is an example of first fan control. The air cleaning operation is an example of second fan control.

In the heat discharging operation, when determining that a temperature inside the printer 100 (hereinafter referred to as "in-printer temperature") is higher than a predetermined threshold temperature, based on output signals from the temperature sensor 64, the printer 100 operates the fan 61 to generate an air current in such a direction as to discharge air to the outside from the inside of the printer 100. The threshold temperature is a threshold value of the in-printer temperature and used for determining whether the heat discharging operation needs to be performed.

By discharging air from the inside to the outside of the printer 100, air of a temperature lower than the in-printer temperature is introduced into the printer 100. Therefore, it is possible to lower the in-printer temperature. Further, based on a difference between the in-printer temperature and the threshold temperature, as the in-printer temperature is higher, the printer 100 operates the fan 61 with a higher intensity (i.e., at a higher rotational speed). Namely, as the fan 61 is operated at a higher rotational speed, a flow rate of an air current generated by the fan 61 is higher, and a higher level of heat discharging efficiency is provided.

On the other hand, in the air cleaning operation, when determining that an amount of particles in a unit volume of air (i.e., an air contamination amount) is larger than a predetermined threshold contamination amount, based on output signals from the dust sensor 62, the printer 100 operates the fan 61 to generate an air current in such a direction as to discharge air to the outside from the inside of the printer 100. The threshold contamination amount is a threshold value of the amount of particles in a unit volume of air and used for determining whether the air cleaning operation needs to be performed.

The fan 61 is disposed between the exhaust port 22 and the filter 63. Therefore, the air discharged to the outside of the printer 100 via the filter 63 is clean air. Further, by discharging air to the outside from the inside of the printer 100, outside air around the printer 100 is introduced into printer 100, and the introduced air is cleaned and discharged to the outside. Therefore, it is possible to clean air outside the printer 100. Moreover, based on the difference between the amount of particles in a unit volume of air (i.e., the air contamination amount) and the threshold contamination amount, as the amount of particles in a unit volume of air is larger, the printer 100 operates the fan 61 with a higher intensity (i.e., at a higher rotational speed). As the rotational speed of the fan 61 is higher, the flow rate of the air current generated by the fan 61 is higher, and a higher level of air cleaning efficiency is provided.

When at least one switching condition is satisfied among one or more switching conditions for switching an operational mode for the fan 61, the printer 100 performs at least one of the heat discharging operation and the air cleaning operation. For instance, while performing a printing operation, the printer 100 puts a higher priority on the heat discharging operation. Meanwhile, when not performing a printing operation, the printer 100 puts a higher priority on the air cleaning operation. Thus, the printer 100 performs both the heat discharging operation and the air cleaning operation. In addition, when a condition is satisfied under which one of the heat discharging operation and the air cleaning operation is unnecessary, the printer 100 performs the other one of the heat discharging operation and the air cleaning operation. Furthermore, when determining that none of the heat discharging operation and the air cleaning operation needs to be performed, the printer 100 stops the rotation of the fan 61.

In the illustrative embodiment, the printer 100 accepts a user selection of a necessity level for the air cleaning operation. The necessity level for the air cleaning operation represents to what extent the air cleaning operation needs to be performed. When accepting a user selection of a necessity level for the air cleaning operation, the printer 100 stores into the NVRAM 34 information on the selected necessity level for the air cleaning operation.

Subsequently, referring to FIG. 4, an explanation will be provided of a procedure of an in-printing control process to be executed in a printing operation. By executing the in-printing control process, it is possible to achieve the aforementioned operations for controlling the fan 61. Upon receiving a print job (as a trigger or a condition for starting the in-printing control process), the CPU 31 of the printer 100 begins to perform the in-printing control process, based on one or more control programs 32*a* read out from the ROM 32. It is noted that the CPU 31 may begin the in-printing control process in response to a fixing temperature control process being started in the printing operation based on the received print job. The trigger or the condition for starting the in-printing control process is an example of a first condition. For instance, the first condition may be satisfied when the CPU 31 receives a print job during a period of time when the image forming unit 10 is not performing a printing operation. Further, the first condition may be satisfied when the CPU 31 begins to control the fuser unit 56 to maintain the appropriate fixing temperature, after receiving the print job.

Figure 5:
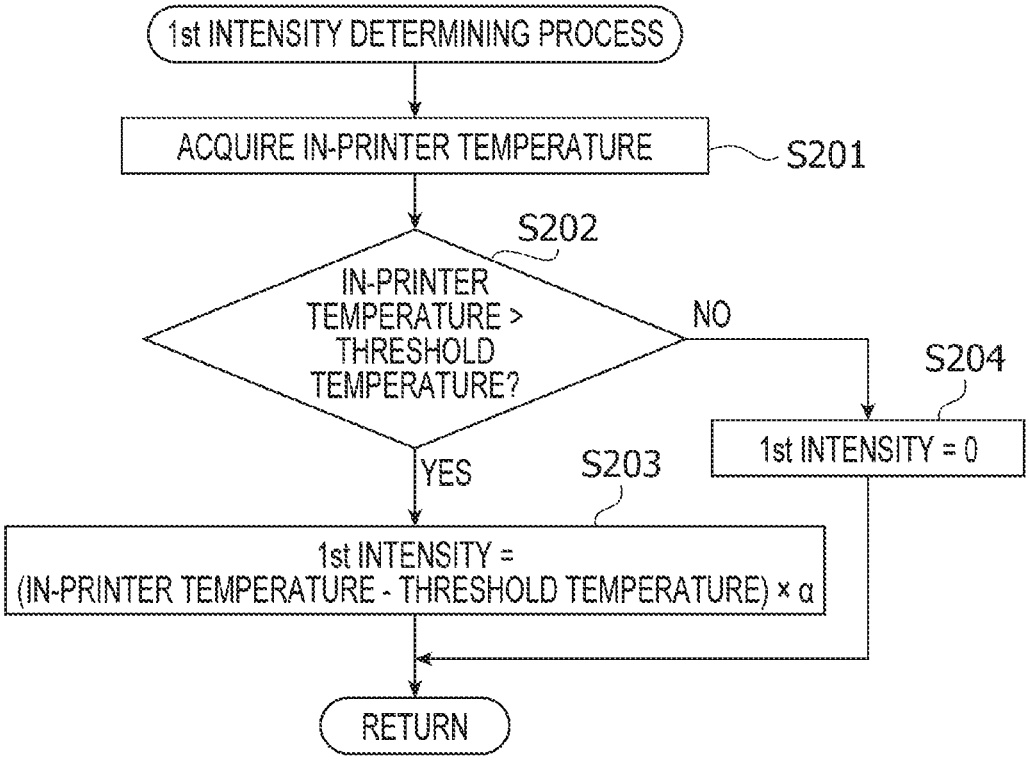
FIG. 5 is a flowchart showing a procedure of a first intensity determining process to be executed in the in-printing control process in the illustrative embodiment according to one or more aspects of the present disclosure.

In the in-printing control process, the CPU 31 performs a first intensity determining process (S101). The first intensity determining process is a process to determine an intensity for operating the fan 61 (i.e., a rotational speed of the fan 61) in the aforementioned heat discharging operation. Next, a procedure of the first intensity determining process will be described with reference to FIG. 5.

In the first intensity determining process, firstly, the CPU 31 acquires an in-printer temperature based on output signals from the temperature sensor 64 (S201). Then, the CPU 31 determines whether the in-printer temperature is higher than a predetermined threshold temperature (S202). The threshold temperature is the lowest value in a range of the in-printer temperature within which the heat discharging operation is required. The threshold temperature is stored in the ROM 32. For instance, the threshold temperature may be 40° C.

When determining that the in-printer temperature is higher than the predetermined threshold temperature (S202: Yes), the CPU 31 determines a first intensity using the following expression 1 (S203).

$$\text{First Intensity}=(\text{In-printer Temperature}-\text{Threshold Temperature})\times\text{Coefficient }\alpha, \quad \text{<Expression 1>}$$

where coefficient $\alpha$ is a conversion factor for converting a temperature difference into an intensity for operating the fan 61.

After determining the first intensity, the CPU 31 terminates the first intensity determining process.

Meanwhile, when determining that the in-printer temperature is not higher than the predetermined threshold temperature (S202: No), the CPU 31 determines that there is no need to perform the heat discharging operation and sets the first intensity to zero (S204). Thereafter, the CPU 31 terminates the first intensity determining process.

Figure 4:
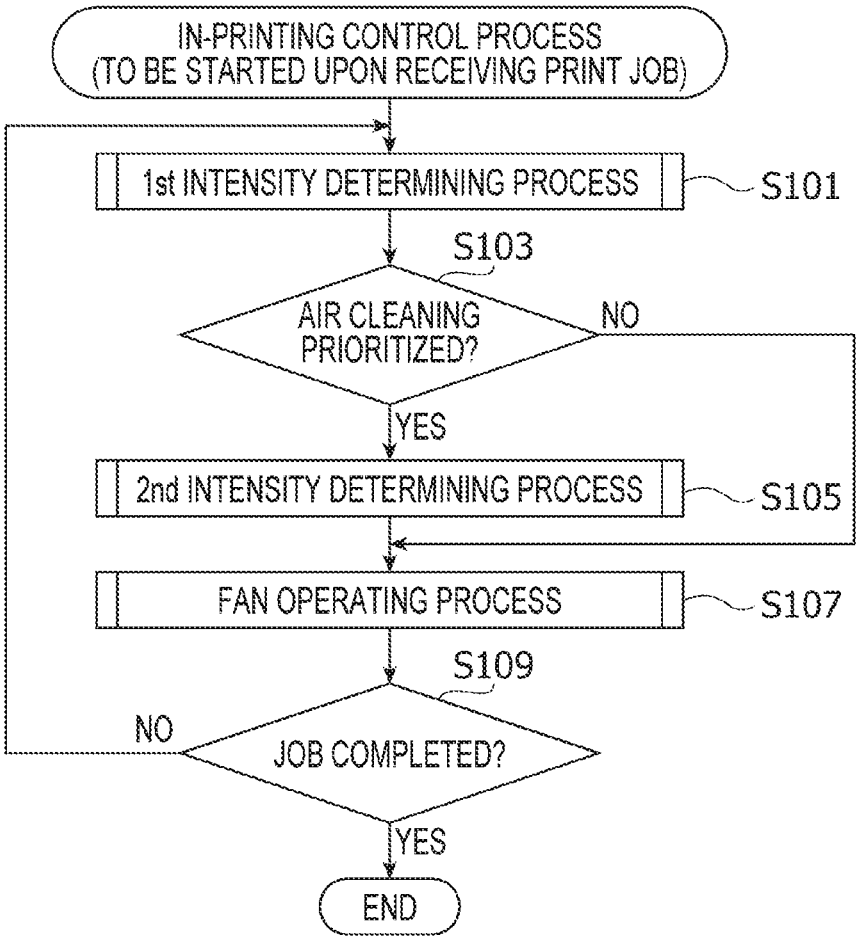
FIG. 4 is a flowchart showing a procedure of an in-printing control process to be executed by a CPU of the printer in the illustrative embodiment according to one or more aspects of the present disclosure.

Referring back to the in-printing control process shown in FIG. 4, after the first intensity determining process in S101, the CPU 31 reads out the information on the necessity level for the air cleaning operation from the NVRAM 34, and determines whether the air cleaning operation is set to be prioritized (S103). As described above, the printer 100 accepts a user selection of a necessity level for the air cleaning operation and stored into the NVRAM 34 the information on the accepted necessity level for the air cleaning operation. Then, when information on a high necessity level for the air cleaning operation is stored in the NVRAM 34, the printer 100 (the CPU 31) determines that the air cleaning operation is prioritized.

When the air cleaning operation is set to be prioritized, after accepting a print job, the printer 100 (the CPU 31) operates the fan 61 for the air cleaning operation even in a state where the temperature of the fuser unit 56 has not risen up to a fixing temperature required for a fixing operation. When the fan 61 is rotated, heat is discharged from the fuser unit 56 as well, and therefore, it takes a longer period of time for the temperature of the fuser unit 56 to rise up to the fixing temperature. Namely, when the air cleaning operation is set to be prioritized, a longer waiting period of time is required until the printing operation is started than when the air cleaning operation is not set to be prioritized.

Meanwhile, when the air cleaning operation is not set to be prioritized, the printer 100 does not rotate the fan 61 for the air cleaning operation during execution of the print job. Namely, in a state where the temperature of the fuser unit 56 has not risen up to the fixing temperature required for the fixing operation, the printer 100 puts a higher priority on raising the temperature of the fuser unit 56 and stops the fan 61. Thus, when the air cleaning operation is not set to be prioritized, the waiting period of time required until the start of the printing operation is shorter than when the air cleaning operation is set to be prioritized.

When determining that the air cleaning operation is set to be prioritized (S103: Yes), the CPU 31 performs a second intensity determining process (S105). The second intensity determining process is a process to determine an intensity for operating the fan 61 for the air cleaning operation. A procedure of the second intensity determining process will be described with reference to FIG. 6.

In the second intensity determining process, firstly, the CPU 31 reads out a first contamination amount from the NVRAM 34 (S301). The first contamination amount represents an amount of particles in a unit volume of air outside the printer 100. The first contamination amount is acquired in a below-mentioned contamination amount checking process, and is stored in the NVRAM 34. The contamination amount checking process is a process to acquire a contamination amount of air around the printer 100 and a deterioration level of the filter 63. The contamination amount checking process is periodically performed by the printer 100 (more specifically, by the CPU 31 of the printer 100).

Figure 7:
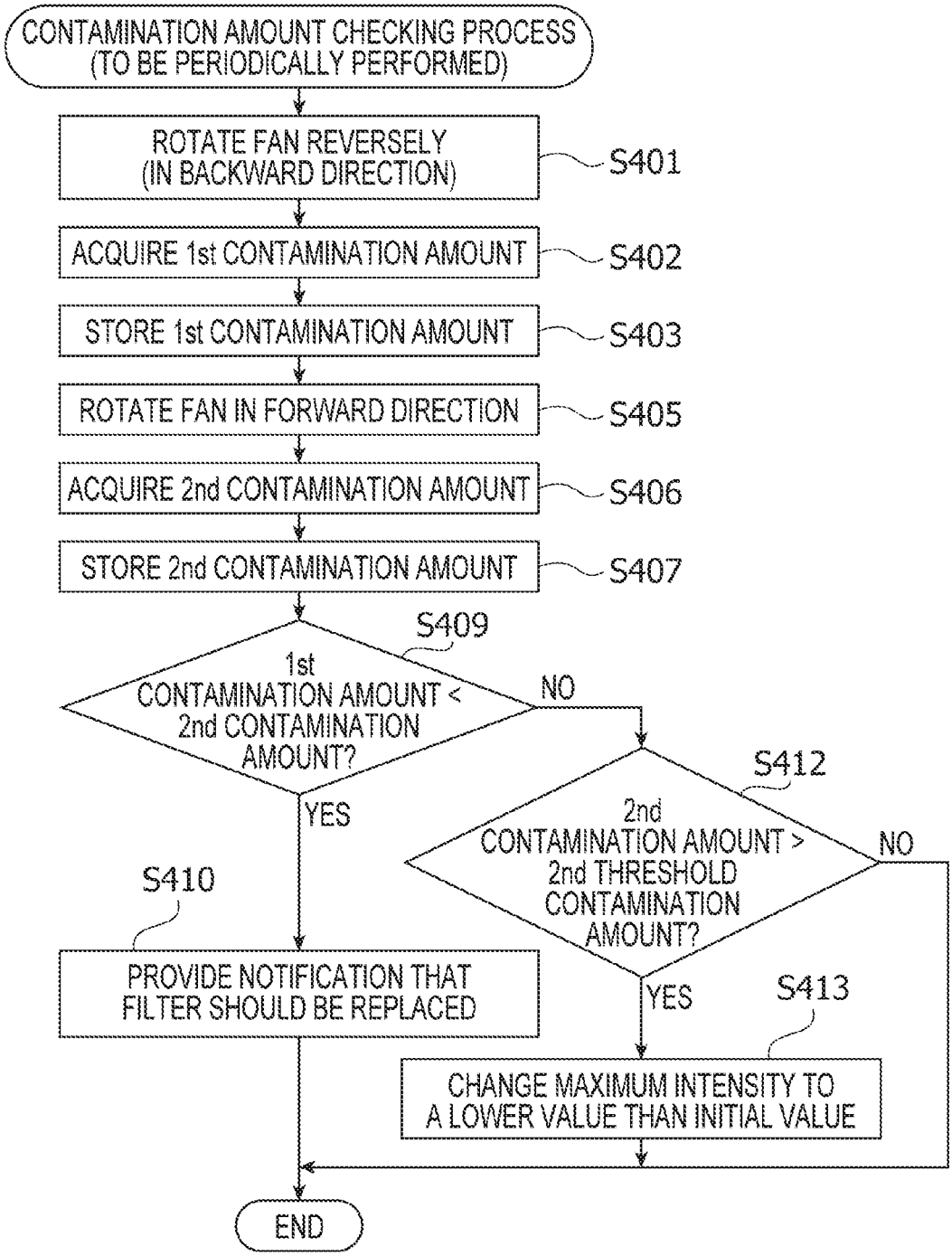
FIG. 7 is a flowchart showing a procedure of a contamination amount checking process to be periodically executed by the CPU of the printer in the illustrative embodiment according to one or more aspects of the present disclosure.

Hereinafter, a procedure of the contamination amount checking process will be described with reference to FIG. 7. The contamination amount checking process is performed periodically (e.g., every hour) during a period of time when the printing operation is not executed. When the contamination amount checking process is started, firstly, the CPU 31 reversely rotates the fan 61 for a particular period of time (e.g., 3-10 seconds) (S401). The reverse rotation is rotation in a backward direction opposite to a forward direction of the fan 61 in the heat discharging operation and the air cleaning operation. Namely, the CPU 31 controls the fan 61 to rotate in such a rotational direction as to generate an air current flowing from the outside to the inside of the printer 100, and introduces air outside the printer 100 into the dust sensor 62 via the exhaust port 22.

Then, the CPU 31 acquires a contamination amount of the air outside the printer 100, based on output signals from the dust sensor 62 (S402). Hereinafter, the air contamination amount acquired in S402 will be referred to as "first contamination amount." The CPU 31 stores the acquired first contamination amount into the NVRAM 34 (S403). The step S403 is an example of a first contamination storing process.

Subsequently, the CPU 31 controls the fan 61 to rotate in the forward direction for a particular period of time (S405). As described above, the forward direction is a rotational direction of the fan 61 in the heat discharging operation and the air cleaning operation. Thereby, the CPU 31 generates an air current flowing from the inside to the outside of the printer 100, and introduces the air inside the printer 100 into the dust sensor 62 via the filter 63.

Then, the CPU 31 acquires a contamination amount of the air having passed through the filter 63, based on output signals from the dust sensor 62 (S406). The air contamination amount acquired in S406 will be referred to as "second contamination amount." The CPU 31 stores the acquired second contamination amount into the NVRAM 34 (S407). The step S407 is an example of a second contamination storing process. It is noted that the process to acquire the second contamination amount may be performed in advance of the process to acquire the first contamination amount. Namely, the steps S405 to S407 may be executed in advance of the steps S401 to S403.

Then, the CPU 31 compares the first contamination amount acquired in S402 with the second contamination amount acquired in S405, and determines whether the first contamination amount is smaller than the second contamination amount (S409). When determining that the first contamination amount is smaller than the second contamination amount (S409: Yes), the CPU 31 provides a notification that the filter 63 should be replaced with a new one (S410). Thereafter, the CPU 31 terminates the contamination amount checking process. When the air having passed through the filter 63 is more contaminated than the air outside the printer 100, it is highly likely that the filter 63 is deteriorated. Hence, in S410, for instance, the CPU 31 may display on the operation panel 40 a message that prompts the user to replace the filter 63 with a new one.

Meanwhile, when determining that the first contamination amount is not smaller than the second contamination amount (S409: No), the CPU 31 determines whether the second contamination amount is larger than a second threshold contamination amount (S412). When the contamination amount of the air having passed through the filter 63 is larger than the second threshold contamination amount, the filter 63 is deteriorated to some degree, even though the deterioration degree is not such a degree that the filter 63 needs to be replaced. The second threshold contamination amount is larger than the aforementioned threshold contamination amount for determining whether the air cleaning operation needs to be performed. The second threshold contamination amount is stored in the ROM 32. When determining that the second contamination amount is not larger than the second threshold contamination amount (S412: No), the CPU 31 terminates the contamination amount checking process.

When determining that the second contamination amount is larger than the second threshold contamination amount (S412: Yes), the CPU 31 changes a maximum intensity to a lower value than an initial value, and stores the changed maximum intensity into the NVRAM 34 (S413). Thereafter, the CPU 31 terminates the contamination amount checking process. The maximum intensity is an upper limit of settable intensities for operating the fan 61, and is used for a below-mentioned fan operating process. It is noted that the initial value of the maximum intensity is stored in the ROM 32.

When the filter 63 is deteriorated to a small degree, a larger volume of air passing through the filter 63 provides a better air cleaning effect. Nonetheless, when the filter 63 is deteriorated to a particular degree, to obtain a better air cleaning effect, the volume of air passing through the filter 63 should not be so large. Therefore, when the second contamination amount is larger than the second threshold contamination amount, the CPU 31 makes the maximum intensity for operating the fan 61 smaller than the initial value, and stores the changed maximum intensity into the NVRAM 34. It is noted that the determination as to whether the filter 63 is deteriorated may not necessarily be made based on the second contamination amount. The CPU 31 may determine that the filter 63 is deteriorated when a filter usage quantity evaluated since the filter 63 began to be used is more than a particular quantity. The filter usage quantity may be determined based on at least one of a period of time during which the filter 63 has been used since the filter 63 was attached and an accumulated volume of air passed through the filter 63.

When the filter 63 is replaced with a new one, the CPU 31 may return the maximum intensity for operating the fan 61 to the initial value. For instance, when determining that the second contamination amount is smaller than the second threshold contamination amount, the CPU 31 may delete the maximum intensity stored in the NVRAM 34. Further, the CPU 31 may determine whether the filter 63 has been replaced, based on a user input or detecting attachment/detachment of the filter 63.

Figure 6:
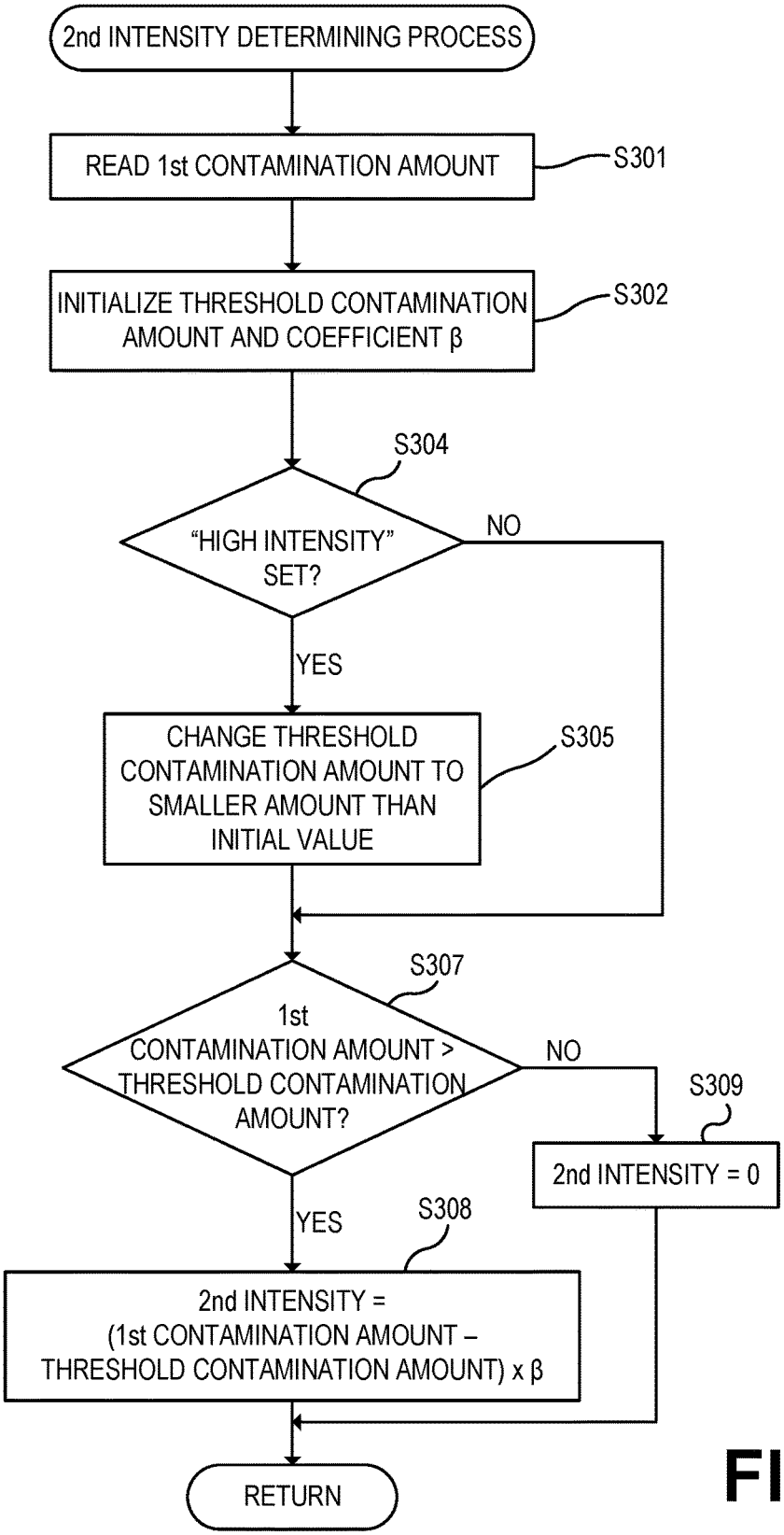
FIG. 6 is a flowchart showing a procedure of a second intensity determining process to be executed in the in-printing control process in the illustrative embodiment according to one or more aspects of the present disclosure.

Referring back to the second intensity determining process shown in FIG. 6, after reading out the first contamination amount from the NVRAM 34 in S301, the CPU 31 sets the threshold contamination amount and a coefficient 3 to their respective initial values (S302). The threshold contamination amount is the lowest value in a range of the first contamination amount within which the air cleaning operation is required. The coefficient β is a conversion factor for converting a contamination amount into an intensity for operating the fan 61. The respective initial values of the threshold contamination amount and the coefficient β are stored in the ROM 32.

Further, the CPU 31 determines whether "high intensity" is set for the air cleaning operation (S304). For instance, the "high intensity" is set by a user who wishes to perform the air cleaning operation with a high intensity. The setting of "high intensity" is stored in the NVRAM 34. An operational mode in which the "high intensity" is set for the air cleaning operation is an example of a first mode. An operational mode in which the "high intensity" is not set for the air cleaning operation is an example of a second mode. When determining that the "high intensity" is set for the air cleaning operation (S304: Yes), the CPU 31 changes the threshold contamination amount to a smaller amount than the initial value (S305).

Then, after S305, or when determining that the "high intensity" is not set for the air cleaning operation (S304: No), the CPU 31 determines whether the first contamination amount read in S301 is larger than the threshold contamination amount (S307). When determining that the first contamination amount is larger than the threshold contamination amount (S307: Yes), the CPU 31 determines a second intensity using the following expression 2 (S308).

$$\text{Second Intensity} = (\text{First Contamination Amount} - \text{Threshold Contamination Amount}) \times \text{Coefficient } \beta \quad \text{<Expression 2>}$$

After determining the second intensity, the CPU 31 terminates the second intensity determining process.

Meanwhile, when determining that the first contamination amount is not larger than the threshold contamination amount (S307: No), the CPU 31 determines that there is no need to perform the air cleaning operation and sets the second intensity to zero (S309). Thereafter, the CPU 31 terminates the second intensity determining process. It is noted that, in the setting of "high intensity," instead of making the threshold contamination amount lower, the coefficient β may be made larger. Alternatively, both of the threshold contamination amount and the coefficient β may be changed.

Referring back to the in-printing control process shown in FIG. 4, after the second intensity determining process in S105, or when determining that the air cleaning operation is not set to be prioritized (S103: No), the CPU 31 performs a fan operating process (S107). The fan operating process is a process to determine the intensity for operating the fan 61 based on the first intensity determined in the first intensity determining process and the second intensity determined in the second intensity determining process, and operate the fan 61 with the determined intensity.

Figure 8:
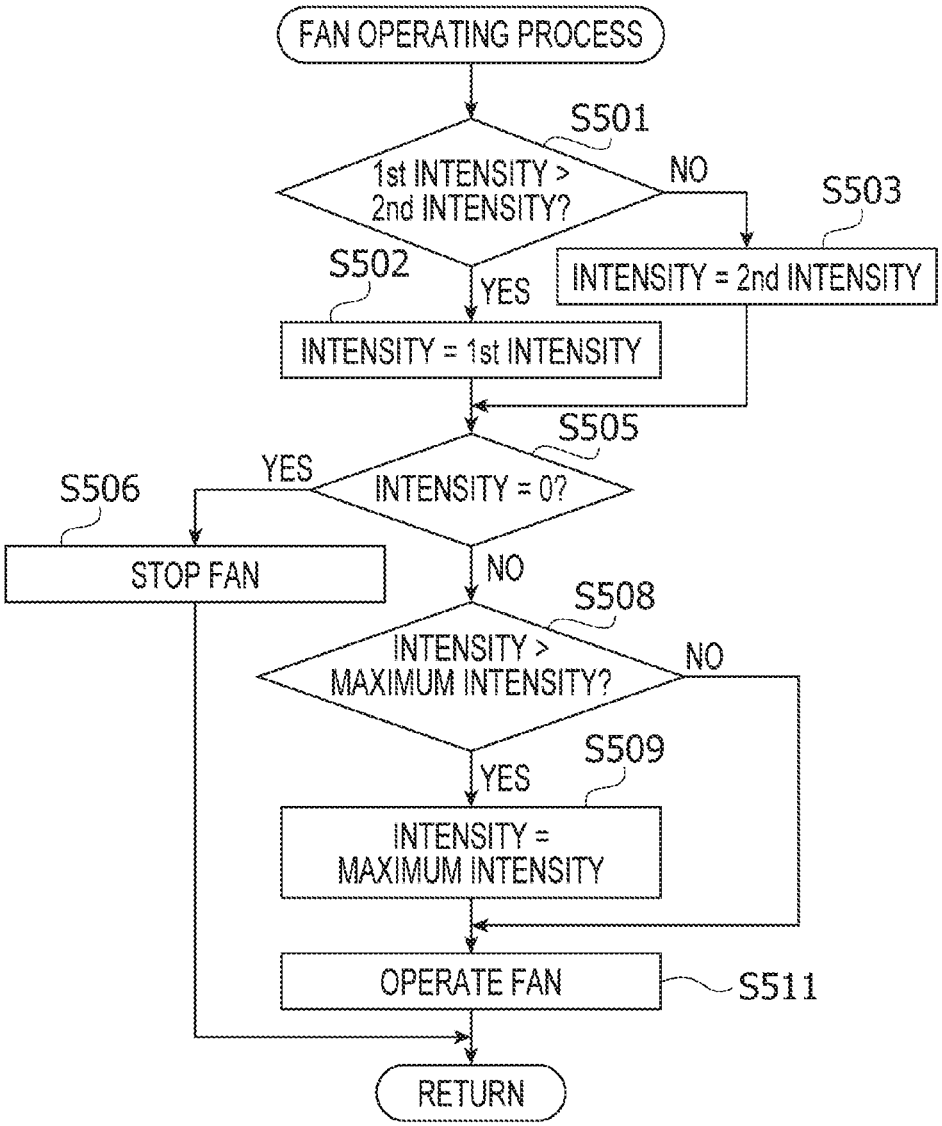
FIG. 8 is a flowchart showing a procedure of a fan operating process to be executed in the in-printing control process in the illustrative embodiment according to one or more aspects of the present disclosure.

Subsequently, a procedure of the fan operating process will be described with reference to FIG. 8. In the fan operating process, firstly, the CPU 31 compares the first intensity determined in S101 with the second intensity determined in S105, and determines whether the first intensity is higher than the second intensity (S501). When determining that the first intensity is higher than the second intensity (S501: Yes), the CPU 31 sets the intensity for the fan 61 to the first intensity (S502). Meanwhile, when determining that the first intensity is not higher than the second intensity (S501: No), the CPU 31 sets the intensity for the fan 61 with the second intensity (S503).

Further, the CPU 31 determines whether the intensity for the fan 61 determined in S502 or S503 is equal to zero (S505). When determining that the intensity for the fan 61 is equal to zero (S505: Yes), the CPU 31 stops the fan 61 (S506). Thereafter, the CPU 31 terminates the fan operating process.

Meanwhile, when determining that the intensity for the fan 61 is not equal to zero (S505: No), the CPU 31 determines whether the intensity for the fan 61 determined in S502 or S503 is higher than the maximum intensity set in the aforementioned contamination amount checking process (S508). When determining that the intensity for the fan 61 is higher than the maximum intensity (S508: Yes), the CPU 31 sets the intensity for the fan 61 to the maximum intensity (S509). Thereby, it is possible to prevent the fan 61 from being operated with an excessive intensity. Thus, it is possible to efficiently operate the fan 61.

When determining that the intensity for the fan 61 is not higher than the maximum intensity (S508: No), the CPU 31 operates the fan 61 with the intensity determined in S502 or S503 (S511). Thereafter, the CPU 31 terminates the fan operating process. It is noted that, when the fan 61 is once rotated in S511 of the fan operating process, the CPU 31 operates the fan 61 with the same intensity until the fan operating process is performed next time.

Referring back to the in-printing control process shown in FIG. 4, after the fan operating process in S107, the CPU 31 determines whether the print job has been completed (S109). When determining that the print job has not been completed (S109: No), the CPU 31 goes back to S101 and performs the first intensity determining process. Thereby, it is highly likely that the CPU 31 is allowed to control the fan 61 in an appropriate manner depending on the in-printer temperature during execution of the print job. When determining that the print job has been completed (S109: Yes), the CPU 31 terminates the in-printing control process.

It is noted that the determination in S109 may be made based on whether the in-printer temperature is equal to or less than the threshold temperature. Namely, before the in-printer temperature becomes equal to or less than the threshold temperature after the print job has been completed, the CPU 31 may make a negative determination in S109 (S109: No) and continue to rotate the fan 61. When the print job is completed, and the in-printer temperature becomes equal to or less than the threshold temperature, the CPU 31 may make a positive determination in S109 (S109: Yes) and terminate the in-printing control process.

Further, the CPU 31 performs a non-printing control process periodically (e.g., every an hour) during a period of time when not performing a printing operation. Subsequently, a procedure of the non-printing control process will be described with reference to FIG. 9. For instance, in response to determining that there is not next print job to be executed after completion of a current print job and that the in-printer temperature acquired based on output signals from the temperature sensor 64 is equal to or less than the threshold temperature, the CPU 31 may begin the non-printing control process. The condition for beginning the non-printing control process is an example of a second condition.

Figure 9:
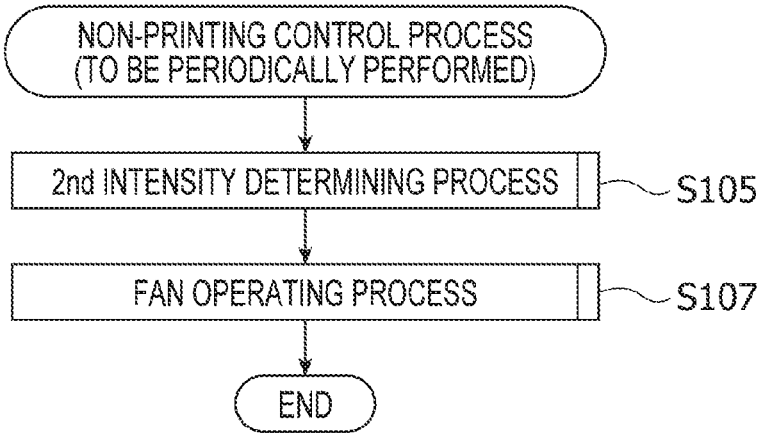
FIG. 9 is a flowchart showing a procedure of a non-printing control process to be periodically executed by the CPU of the printer during a period of time when a printing operation is not being performed, in the illustrative embodiment according to one or more aspects of the present disclosure.

While the printer 100 is not performing a printing operation, there are few factors to raise the in-printer temperature. Therefore, there is seldom any need to perform the heat discharging operation. Hence, in the non-printing control process, the printer 100 does not perform the heat discharging operation but performs the air cleaning operation. As shown in FIG. 9, the non-printing control process is a process to perform the second intensity determining process (S105) and the fan operating process (S107). It is noted that the second intensity determining process and the fan operating process are the same as those included in the in-printing control process. Namely, the non-printing control process is equivalent to the in-printing control process from which the steps S101, S103, and S109 are omitted.

When the printer 100 is turned on, firstly, the CPU 31 starts the non-printing control process. The turn-on is an example of the one or more switching conditions. Then, when accepting a print job in a state where the printer 100 is not performing a printing operation, the CPU 31 halts the non-printing control process and starts the in-printing control process. The acceptance of a print job in a state where the printer 100 is not performing a printing operation is an example of the one or more switching conditions. Then, when completing the print job, the CPU 31 terminates the in-printing control process and starts the non-printing control process. The completion of the in-printing control process is an example of the one or more switching conditions. It is noted that as a switching condition, a switching instruction may be input by the user.

Thereby, while the printer 100 is performing a printing operation, the CPU 31 performs the heat discharging operation depending on the in-printer temperature, and performs the air cleaning operation as needed. The necessity level for the air cleaning operation is set based on user settings. Meanwhile, while the printer 100 is not performing a printing operation, the CPU 31 does not perform the heat discharging operation, and performs the air cleaning operation depending on the air contamination amount.

Even while the printer 100 is not performing a printing operation, the CPU 31 may perform the heat discharging operation. In other words, the CPU 31 may perform the in-printing control process regardless of whether the printer 100 is performing a printing operation. In this case, the determination in S109 as to whether the print job has been completed is unnecessary. While the printer 100 is being powered on, the CPU 31 may periodically repeat the in-printing control process.

As described above, according to the illustrative embodiment, the printer 100 includes the fan 61 and the filter 63, and controls the fan 61 to generate an air current and causes the filter 63 to catch particles scattering in air. Further, the printer 100 is configured to perform the heat discharging operation based on output signals from the temperature sensor 64 and perform the air cleaning operation based on output signals from the dust sensor 62. Then, when at least one switching condition is satisfied, the printer 100 performs at least one of the heat discharging operation and the air cleaning operation. Accordingly, it is possible to operate the fan 61 in a favorable manner to achieve both effects, i.e., preventing an excessive rise in the in-printer temperature and reducing the amount of particles scattering in air around the fan 61.

More specifically, for instance, the printer 100 is configured to accept a user selection of a necessity level for the air cleaning operation. When the selected necessity level is high, the printer 100 performs the air cleaning operation even while performing a printing operation. Therefore, even after the printing operation is started, it is possible to continuously execute the air cleaning function. Meanwhile, when the selected necessity level is low, the printer 100 stops the air cleaning operation when starting the printing operation. Therefore, it is possible to shorten a period of time required for raising the temperature of the fuser unit 56. Thus, it is possible to achieve a higher level of productivity in the printing operation.

In the aforementioned illustrative embodiment, the printer 100 includes the fan 61 configured to, when rotated in the backward direction, generate a reversely-flowing air current. Nonetheless, aspects of the present disclosure may be applied to a printer that includes a fan configured to only generate an air current flowing in a single direction, instead of the fan 61. For instance, as shown in FIG. 10, aspects of the present disclosure may be applied to a printer 200 that includes an exhaust fan 71 configured to generate an air current flowing from the inside to the outside of the printer 200. For example, a sirocco fan may be used as the exhaust fan 71. The exhaust fan 71 is an example of the fan.

In the printer 200 having the exhaust fan 71, as shown in FIG. 10, the exhaust fan 71, a filter 63, and a dust sensor 62 are arranged between the exhaust port 22 and the fuser unit 56 in an order from the side of the exhaust port 22. The filter 63 and the dust sensor 62 of the printer 200 are substantially the same as the filter 63 and the dust sensor 62 of the printer 100.

In the printer 200, since the exhaust fan 71, the filter 63, and the dust sensor 62 are arranged as shown in FIG. 10, when the exhaust fan 71 is rotated, air to be detected by the dust sensor 62 is introduced from the outside to the inside of the printer 200 without passing through the filter 63. Namely, by operating the exhaust fan 71 for a particular period of time or longer without performing a printing operation, the printer 200 is allowed to acquire a contamination amount of air around the printer 200. Then, the printer 200 stores the acquired air contamination amount into the NVRAM 34.

Further, the printer 200 is configured to perform an air cleaning operation based on the air contamination amount stored in the NVRAM 34. The printer 200 performs the air cleaning operation using the "air contamination amount" instead of the "first contamination amount" in the second intensity determining process shown in FIG. 6. Namely, when the air contamination amount stored in the NVRAM 34 is larger than the threshold contamination amount, the printer 200 the printer 200 rotates the exhaust fan 71. It is noted that a heat discharging operation in the printer 200 is substantially the same as the heat discharging operation in the printer 100.

In the same manner as the printer 100, when at least one of the one or more switching conditions is satisfied, the printer 200 performs at least one of the heat discharging operation and the air cleaning operation. Thereby, in the printer 200 as well that includes the exhaust fan 71 configured to generate an air current flowing in a fixed single direction, it is possible to operate the exhaust fan 71 in a favorable manner to achieve both effects, i.e., preventing an excessive rise in the in-printer temperature and reducing the amount of particles scattering in air around the exhaust fan 71.

Hereinabove, the illustrative embodiment according to aspects of the present disclosure has been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only an exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

Aspects of the present disclosure may be applied to apparatuses and devices having an image forming function such as copy machines, multi-function peripherals, and facsimile machines. Further, aspects of the present disclosure may be applied to apparatuses and devices configured specifically for monochrome printing as well as apparatuses and devices configured to perform color printing.

For instance, the position where the temperature sensor 64 is to be disposed is not limited to the position exemplified in FIG. 2. The temperature sensor 64 may be disposed in any place in the printer 100. Further, the detection position where the in-printer temperature is to be detected by the temperature sensor 64 may be any position in the printer 100. For instance, the temperature sensor 64 may be disposed to detect a surface temperature of the fuser unit 56. The threshold temperature may be set appropriately depending on where the temperature sensor 64 is disposed and where the detection position of the temperature sensor 64 is.

As described above, the ROM 32 stores therein various threshold values and initial values. Nonetheless, the values may be stored in the NVRAM 34. When the values are stored in the NVRAM 34, user settings may be accepted.

The method for restricting the rotational speed of the fan 61 when the filter 63 has deteriorated is not limited to reducing a maximum rotational speed of the fan 61, but may be, for instance, making smaller the coefficient $\beta$ in the expression 2.

The processes exemplified in the aforementioned illustrative embodiment may be executed by one or more hardware elements such as one or more CPUs, one or more ASICs, or a combination of one or more CPUs and one or more ASICs. The processes exemplified in the aforementioned illustrative embodiment may be executed in accordance with computer software stored on a non-transitory computer-readable medium or a method adapted to be implemented on one or more hardware elements.

What is claimed is:

1. An image forming apparatus comprising:

an exhaust port;

a filter configured to catch scattering particles from air passed therethrough;

a fan disposed between the exhaust port and the filter, the fan being configured to generate an air current;

a temperature sensor configured to detect an in-apparatus temperature by outputting signals varying depending on the in-apparatus temperature, the in-apparatus temperature being a temperature in a particular position inside the image forming apparatus;

a contamination sensor configured to detect air contamination amount by outputting signals varying depending on the air contamination amount, the air contamination amount representing an amount of particles scattering in a particular volume of air;

an image forming unit; and a controller configured to perform both first fan control to control the fan to generate an air current when the in-apparatus temperature detected by the temperature sensor is higher than a threshold temperature and second fan control to control the fan to generate an air current when the air contamination amount detected by the contamination sensor is larger than a threshold contamination amount, the controller being further configured to perform at least one of the first fan control and the second fan control when at least one switching condition is satisfied among one or more switching conditions for switching fan control.

2. The image forming apparatus according to claim 1, wherein the controller is further configured to perform the first fan control when a first condition is satisfied among the one or more switching conditions, the first condition being satisfied when the controller receives a print job in a state where the image forming unit is not performing an image forming operation.

3. The image forming apparatus according to claim 2, further comprising a fuser unit configured to thermally fix a developer image formed on a sheet, at a particular fixing temperature, wherein the first condition is satisfied when the controller begins to control the fuser unit to maintain the particular fixing temperature, after receiving the print job.

4. The image forming apparatus according to claim 2, further comprising a storage device configured to store information on a necessity level for air cleaning, the necessity level for air cleaning representing to what extent air cleaning is necessary, wherein the controller is further configured to, in a case where the storage device stores information on a high necessity level for air cleaning, when performing the first fan control in response to the first condition being satisfied, perform the second fan control.

5. The image forming apparatus according to claim 1, wherein the controller is further configured to, when a second condition is satisfied among the one or more switching conditions, stop the first fan control and perform the second fan control, the second condition being satisfied when there is no next print job to be executed after a print job is completed, and the in-apparatus temperature detected by the temperature sensor is equal to or lower than the threshold temperature.

6. The image forming apparatus according to claim 5, wherein the controller is further configured to, after performing the second fan control in response to the second condition being satisfied, when the in-apparatus temperature detected by the temperature sensor becomes higher than the threshold temperature, perform the first fan control.

7. The image forming apparatus according to claim 1, further comprising a storage device configured to store information on a necessity level for air cleaning, the necessity level for air cleaning representing to what extent air cleaning is necessary, wherein the second fan control includes:

a first mode; and a second mode in which at least one of two requirements is satisfied, the two requirements including a requirement for the threshold contamination amount to be set larger than in the first mode and a requirement for a rotational speed of the fan to be set higher than in the first mode, and wherein the controller is further configured to perform the second fan control by:

rotating the fan in the first mode when the storage device stores information on a high necessity level for air cleaning; and rotating the fan in the second mode when the storage device stores information on a not-high necessity level for air cleaning.

8. The image forming apparatus according to claim 1, wherein the contamination sensor is disposed between the fan and the filter, and wherein the controller is further configured to:

in the second fan control, rotate the fan at a higher rotational speed as a first contamination amount increases, the first contamination amount being an air contamination amount detected by the contamination sensor when the fan is rotated in such a direction as to introduce outside air into the image forming apparatus in a state where the image forming unit is not performing an image forming operation; and when a second contamination amount is larger than a second threshold contamination amount, restrict a rotational speed of the fan rotated in the second fan control, the second threshold contamination amount being larger than the threshold contamination amount, the second contamination amount being an air contamination amount detected by the contamination sensor when the fan is rotated in such a direction as to exhaust inside air out of the image forming apparatus in the state where the image forming unit is not performing an image forming operation.

9. The image forming apparatus according to claim 1, wherein the controller is further configured to:

in the second fan control, rotate the fan at a higher rotational speed as the air contamination amount detected by the contamination sensor increases; and when determining that a filter usage quantity evaluated since the filter began to be used is more than a particular quantity, restrict a rotational speed of the fan rotated in the second fan control.

10. The image forming apparatus according to claim 1, further comprising a storage device, wherein the contamination sensor is disposed between the fan and the filter, and wherein the controller is further configured to:

perform a first contamination storing process comprising:

rotating the fan for a particular period of time in such a rotational direction as to introduce outside air into the image forming apparatus, in a state where the image forming unit is not performing an image forming operation; and storing into the storage device an air contamination amount detected by the contamination sensor; and in the second fan control, rotating the fan when the air contamination amount stored in the first contamination storing process is larger than the threshold contamination amount.

11. The image forming apparatus according to claim 10, wherein the controller is further configured to:

perform a second contamination storing process comprising:

rotating the fan for a particular period of time in such a rotational direction as to exhaust inside air out of the image forming apparatus, in the state where the image forming unit is not performing an image forming operation; and storing into the storage device an air contamination amount detected by the contamination sensor; and when the air contamination amount stored in the second contamination storing process is larger than the air contamination amount stored in the first contamination storing process, provide a notification that the filter should be replaced.

12. The image forming apparatus according to claim 1, further comprising a storage device, wherein the filter is disposed between the fan and the contamination sensor, and wherein the controller is further configured to:

rotate the fan for a particular period of time in such a rotational direction as to exhaust inside air out of the image forming apparatus, in a state where the image forming unit is not performing an image forming operation;

store into the storage device an air contamination amount detected by the contamination sensor; and in the second fan control, rotate the fan when the air contamination amount stored in the storage device is larger than the threshold contamination amount.

13. The image forming apparatus according to claim 1, wherein the controller comprises:

a processor; and a memory storing processor-executable instructions configured to, when executed by the processor, cause the processor to perform at least one of the first fan control and the second fan control when at least one switching condition is satisfied among the one or more switching conditions for switching fan control.

14. A method adapted to be implemented on a processor coupled with an image forming apparatus having a fan disposed between an exhaust port and an air filter, the method comprising:

when at least one condition is satisfied among one or more conditions for controlling the fan, performing first fan control comprising:

acquiring an in-apparatus temperature detected by a temperature sensor disposed inside the image forming apparatus;

determining whether the acquired in-apparatus temperature is higher than a threshold temperature;

when determining that the acquired in-apparatus temperature is higher than the threshold temperature, setting a first rotational speed to a speed more than zero; and when determining that the acquired in-apparatus temperature is not higher than the threshold temperature, setting the first rotational speed to zero;

determining whether a storage device of the image forming apparatus stores specific information representing that air cleaning is highly necessary;

when determining that the storage device does not store the specific information, setting a rotational speed for rotating the fan to the first rotational speed;

when determining that the storage device stores the specific information, performing second fan control comprising:

acquiring an air contamination amount detected by a contamination sensor of the image forming apparatus, the air contamination amount representing an amount of particles scattering in a particular volume of air outside the image forming apparatus;

determining whether the acquired air contamination amount is larger than a threshold contamination amount;

when determining the acquired air contamination amount is larger than the threshold contamination amount, setting a second rotational speed to a speed more than zero; and when determining the acquired air contamination amount is not larger than the threshold contamination amount, setting the second rotational speed to zero;

determining whether the first rotational speed is higher than the second rotational speed;

when determining that the first rotational speed is higher than the second rotational speed, setting the rotational speed for rotating the fan to the first rotational speed; and when determining that the first rotational speed is not higher than the second rotational speed, setting the rotational speed for rotating the fan to the second rotational speed.

15. A non-transitory computer-readable medium storing computer-readable instructions that are executable by a processor coupled with an image forming apparatus, the image forming apparatus comprising a fan disposed between an exhaust port and an air filter, the instructions being configured to, when executed by the processor, cause the processor to:

when at least one condition is satisfied among one or more conditions for controlling the fan, perform first fan control comprising:

acquiring an in-apparatus temperature detected by a temperature sensor disposed inside the image forming apparatus;

determining whether the acquired in-apparatus temperature is higher than a threshold temperature;

when determining that the acquired in-apparatus temperature is higher than the threshold temperature, setting a first rotational speed to a speed more than zero; and when determining that the acquired in-apparatus temperature is not higher than the threshold temperature, setting the first rotational speed to zero;

determine whether a storage device of the image forming apparatus stores specific information representing that air cleaning is highly necessary;

when determining that the storage device does not store the specific information, set a rotational speed for rotating the fan to the first rotational speed;

when determining that the storage device stores the specific information, perform second fan control comprising:

acquiring an air contamination amount detected by a contamination sensor of the image forming apparatus, the air contamination amount representing an amount of particles scattering in a particular volume of air outside the image forming apparatus;

determining whether the acquired air contamination amount is larger than a threshold contamination amount;

when determining the acquired air contamination amount is larger than the threshold contamination amount, setting a second rotational speed to a speed more than zero; and when determining the acquired air contamination amount is not larger than the threshold contamination amount, setting the second rotational speed to zero;

determine whether the first rotational speed is higher than the second rotational speed;

when determining that the first rotational speed is higher than the second rotational speed, set the rotational speed for rotating the fan to the first rotational speed; and when determining that the first rotational speed is not higher than the second rotational speed, set the rotational speed for rotating the fan to the second rotational speed.

* * * * *